US010429792B2

(12) United States Patent
Souda et al.

(10) Patent No.: US 10,429,792 B2
(45) Date of Patent: Oct. 1, 2019

(54) WASTE TONER CONTAINER AND IMAGE-FORMING APPARATUS PROVIDED WITH THE SAME

(71) Applicant: Brother Kogyo Kabushiki Kaisha, Nagoya-shi, Aichi-ken (JP)

(72) Inventors: Makoto Souda, Nagoya (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/136,712

(22) Filed: Sep. 20, 2018

(65) Prior Publication Data

US 2019/0179253 A1 Jun. 13, 2019

(30) Foreign Application Priority Data

Dec. 7, 2017 (JP) ..... 2017-234893

(51) Int. Cl.
*G03G 21/00* (2006.01)
*G03G 21/12* (2006.01)
*G03G 21/10* (2006.01)

(52) U.S. Cl.
CPC ..... *G03G 21/12* (2013.01); *G03G 21/105* (2013.01); *G03G 2215/1661* (2013.01); *G03G 2221/1624* (2013.01)

(58) Field of Classification Search
CPC .... G03G 15/161; G03G 21/12; G03G 21/105; G03G 21/1647; G03G 21/169; G03G 2215/1661; G03G 2221/1624; G03G 15/168
USPC ..... 399/101, 360
See application file for complete search history.

(56) References Cited

U.S. PATENT DOCUMENTS 5,079,593 A * 1/1992 Satoh ..... G03G 15/0822 399/111
9,134,684 B2 9/2015 Sato
2007/0122186 A1* 5/2007 Kamimura ..... G03G 15/161 399/110
2009/0220257 A1* 9/2009 Tsusaka ..... G03G 21/12 399/35

(Continued)

FOREIGN PATENT DOCUMENTS

JP 60134273 A * 7/1985 ..... G03G 21/12
JP 06012005 A * 1/1994

(Continued)

*Primary Examiner* — Robert B Beatty
(74) *Attorney, Agent, or Firm* — Banner & Witcoff, Ltd.

(57) ABSTRACT

A waste toner container is attachable to and detachable from a housing of an image-forming apparatus through an opening of the housing. The waste toner container includes a casing and a guide pipe connected to the casing. The casing has a first end and a second end positioned opposite to the opening with respect to the first end in a state where the waste toner container is attached to the housing. The guide pipe is pivotally movable relative to the casing between a first position and a second position. The guide pipe extends in a first direction connecting the first end to the second end at the first position, while extending in a second direction crossing the first direction at the second position. The guide pipe at the first position has a length in the second direction smaller than a length thereof in the second direction at the second position.

17 Claims, 10 Drawing Sheets

(56) References Cited

U.S. PATENT DOCUMENTS

| | | | | |
|---|---|---|---|---|
| 2013/0287412 | A1* | 10/2013 | Koga | G03G 21/1676 399/13 |
| 2014/0037321 | A1 | 2/2014 | Sato | |
| 2014/0186071 | A1* | 7/2014 | Sato | G03G 15/0194 399/110 |
| 2016/0091828 | A1 | 3/2016 | Okazaki et al. | |

FOREIGN PATENT DOCUMENTS

| | | | | |
|---|---|---|---|---|
| JP | 08314348 | A | * | 11/1996 |
| JP | 2000019912 | A | * | 1/2000 |
| JP | 2010204523 | A | * | 9/2010 |
| JP | 2014-032348 | A | | 2/2014 |
| JP | 2016-071214 | A | | 5/2016 |
| JP | 2017-015753 | A | | 1/2017 |
| JP | 2017-015982 | | | 1/2017 |

* cited by examiner

WASTE TONER CONTAINER AND IMAGE-FORMING APPARATUS PROVIDED WITH THE SAME

CROSS REFERENCE TO RELATED APPLICATION

This application claims priority from Japanese Patent Application No. 2017-234893 filed Dec. 7, 2017. The entire content of the priority application is incorporated herein by reference.

TECHNICAL FIELD

The present disclosure relates to a waste toner container and an image-forming apparatus including the container.

BACKGROUND

Japanese Patent Application Publication No. 2016-071214 discloses a waste toner container including a casing and a guide pipe. The casing is configured to store waste toner therein, and the guide pipe is designed to guide the waste toner into the easing.

SUMMARY

However, according to the disclosed waste toner container, the guide pipe may contact neighboring components of a housing of the image-forming apparatus during attachment and detachment of the waste toner container relative to the housing work. Such contact may disturb smooth attachment and detachment of the waste container relative to the housing of the image-forming apparatus.

In view of the foregoing, it is an object of the present disclosure to provide a structure (a waste toner container, and an image-forming apparatus provided with the waste toner container) that can facilitate attachment and detachment of the waste toner container to and from a housing of the image-forming apparatus.

In order to attain the above and other objects, according to one aspect, the disclosure provides a waste toner container attachable to and detachable from a housing of an image-forming apparatus through an opening formed in the housing. The waste toner container includes a casing configured to accommodate waste toner therein, and a guide pipe connected to the casing and configured to guide the waste toner into the casing. The casing has a first end and a second end positioned opposite to the opening with respect to the first end in a state where the waste toner container is attached to the housing. A direction connecting the first end to the second end is a first direction. A direction crossing the first direction is a second direction. The guide pipe has an inlet opening through which the waste toner is introduced into the guide pipe. The guide pipe is pivotally movable relative to the casing between a first position and a second position. The guide pipe at the first position extends in the first direction. The guide pipe at second position extends in the second direction. The guide pipe at the first position has a length in the second direction smaller than a length in the second direction of the guide pipe at the second position.

According to another aspect, the disclosure provides an image-forming apparatus including: the above waste toner container; a housing; a photosensitive drum; a charger configured to charge a peripheral surface of the photosensitive drum; an exposure device configured to expose the peripheral surface of the photosensitive drum to light; a belt in contact with the peripheral surface of the photosensitive drum; a drum cleaning member configured to clean the peripheral surface of the photosensitive drum; and a belt cleaning member configured to clean the belt. The waste toner container is attachable to and detachable from the housing. The waste toner is configured to accommodate waste toner collected by the drum cleaning member and the belt cleaning member in the state where the waste toner container is attached to the housing.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

1. Overview of Image-Forming Apparatus 1.

Figure 1:
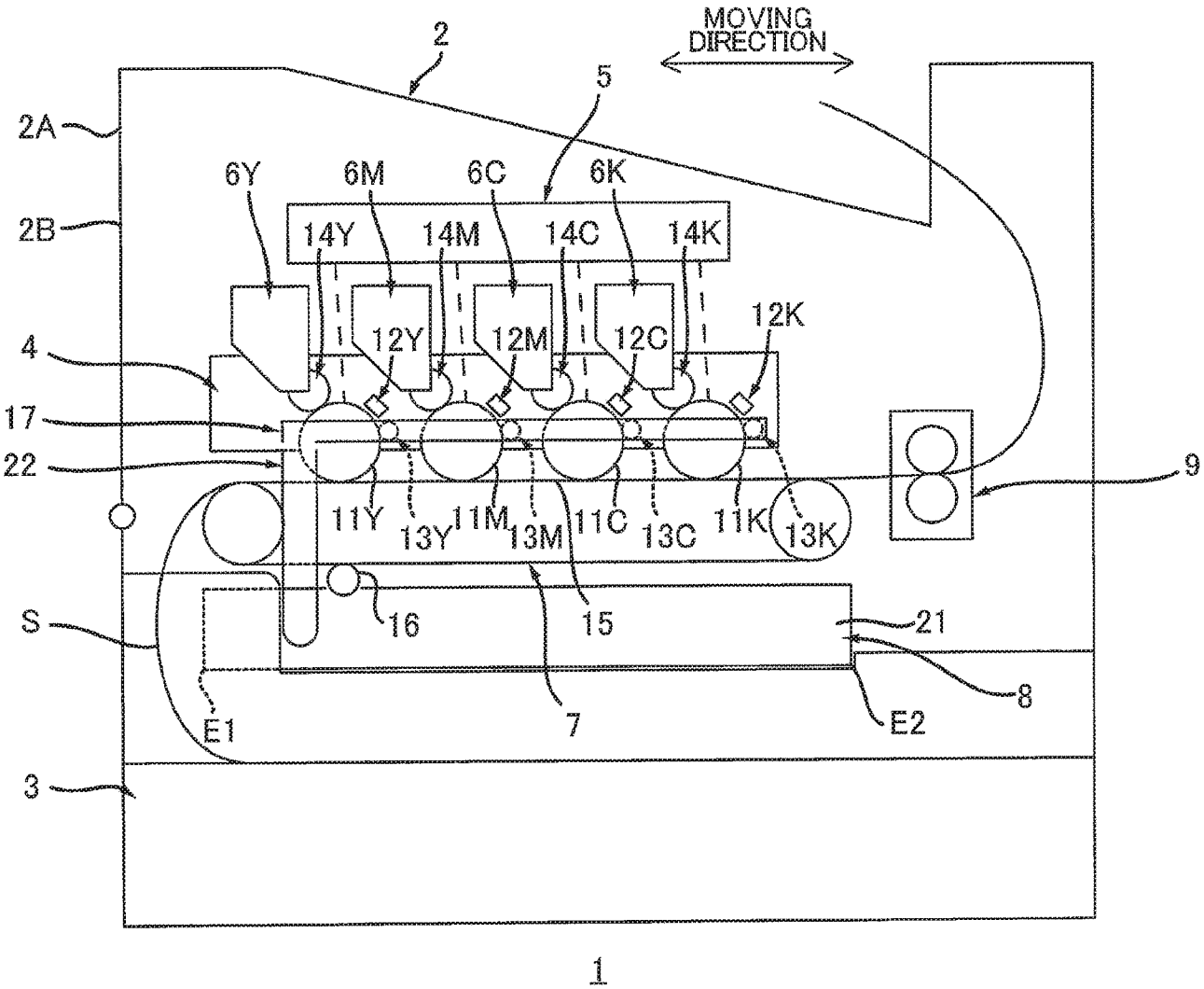
FIG. 1 is a schematic view illustrating an image-forming apparatus according to one embodiment.

An image-forming apparatus 1 according to one embodiment of the disclosure will be described with reference to FIG. 1.

The image-forming apparatus 1 includes a housing 2, a sheet supply portion 3, a drum unit 4, an exposure device 5, a plurality of developing cartridges 6Y, 6M, 6C and 6K, a transfer unit 7, a waste toner container 8, and a fixing device 9.

1.1 Housing 2

The housing 2 accommodates therein the sheet supply portion 3, the drum unit 4, the exposure device 5, the plurality of developing cartridges 6Y, 6M, 6C and 6K, the transfer unit 7, the waste toner container 8, and the fixing device 9. The housing 2 has an opening 2A that is positioned opposite to the fixing device 9 with respect to the drum unit 4 in a state where the drum unit 4 is at its internal position. This internal position will be described later. The housing 2 includes a cover 2B movable between a closed position (FIG. 1) closing the opening 2A and an open position (FIG. 2) opening the opening 2A.

1.2 Sheet Supply Portion 3

The sheet supply portion 3 is configured to accommodate sheets S therein. The sheet supply portion 3 is configured to supply each sheet S toward a photosensitive drum 11Y (described later) of the drum unit 4. The sheet S may be a printing paper, for example.

1.3 Drum Unit 4

In a state where the cover 2B is in an open position, the drum unit 4 is movable relative to the housing 2 between the internal position (FIG. 1) and an external position (FIG. 2) through the opening 2A. At the internal position, the drum unit 4 is positioned inside the housing 2. At the external position, the drum unit 4 is positioned outside the housing 2. Hereinafter, a direction in which the drum unit 4 is movable between the internal position and the external position will be defined as a moving direction. The drum unit 4 includes a plurality of photosensitive drums 11Y, 11M, 11C and 11K, a plurality of chargers 12Y, 12M, 12C and 12K, a plurality of drum cleaning members 13Y, 13M, 13C and 13K, and a waste-toner conveyer tube 17. That is, the image-forming apparatus 1 includes the photosensitive drum 11Y, charger 12Y, and drum cleaning member 13Y.

The photosensitive drum 11Y is cylindrical in shape, and extends in a widthwise direction crossing the moving direction and up-down direction. The photosensitive drum 11Y is rotatable about a rotation axis extending in the widthwise direction.

The charger 12Y is configured to charge the photosensitive drum 11Y. After the charger 12Y charges a peripheral surface of the photosensitive drum 11Y, the exposure device 5 exposes the charged peripheral surface to light to form an electrostatic latent image on the surface of the photosensitive drum 11Y. The charger 12Y is positioned upstream of a developing roller 14Y (described later) in a rotational direction of the photosensitive drum 11Y. The charger 12Y is a Scorotron charger. However, a charge roller is also available as the charger 12Y.

The drum cleaning member 13Y is configured to clean the peripheral surface of the photosensitive drum 11Y before the charger 12Y charges the same. The drum cleaning member 13Y is positioned upstream of the charger 12Y in the rotational direction of the photosensitive drum 11Y. The drum cleaning member 13Y is in contact with the peripheral surface of the photosensitive drum 11Y and removes waste toner therefrom.

Remaining photosensitive drums 11M, 11C and 11K, remaining chargers 12M, 12C and 12K, and remaining drum cleaning members 13M, 13C and 13K have structures and functions the same as those of the photosensitive drum 11Y, the charger 12Y, and the drum cleaning member 13Y, respectively. Therefore, description as to the remaining photosensitive drums 11M, 11C and 11K, the remaining chargers 12M, 12C and 12K, and the remaining drum cleaning members 13M, 13C and 13K will be omitted.

The waste-toner conveyer tube 17 is configured to convey the waste toner removed by the plurality of drum cleaning members 13Y, 13M, 13C and 13K. The waste-toner conveyer tube 17 is connected to a guide pipe 22 (described later) of the waste toner container 8 in a state where the waste toner container 8 is attached to the housing 2 and the drum unit 4 is at the internal position.

Figure 5:
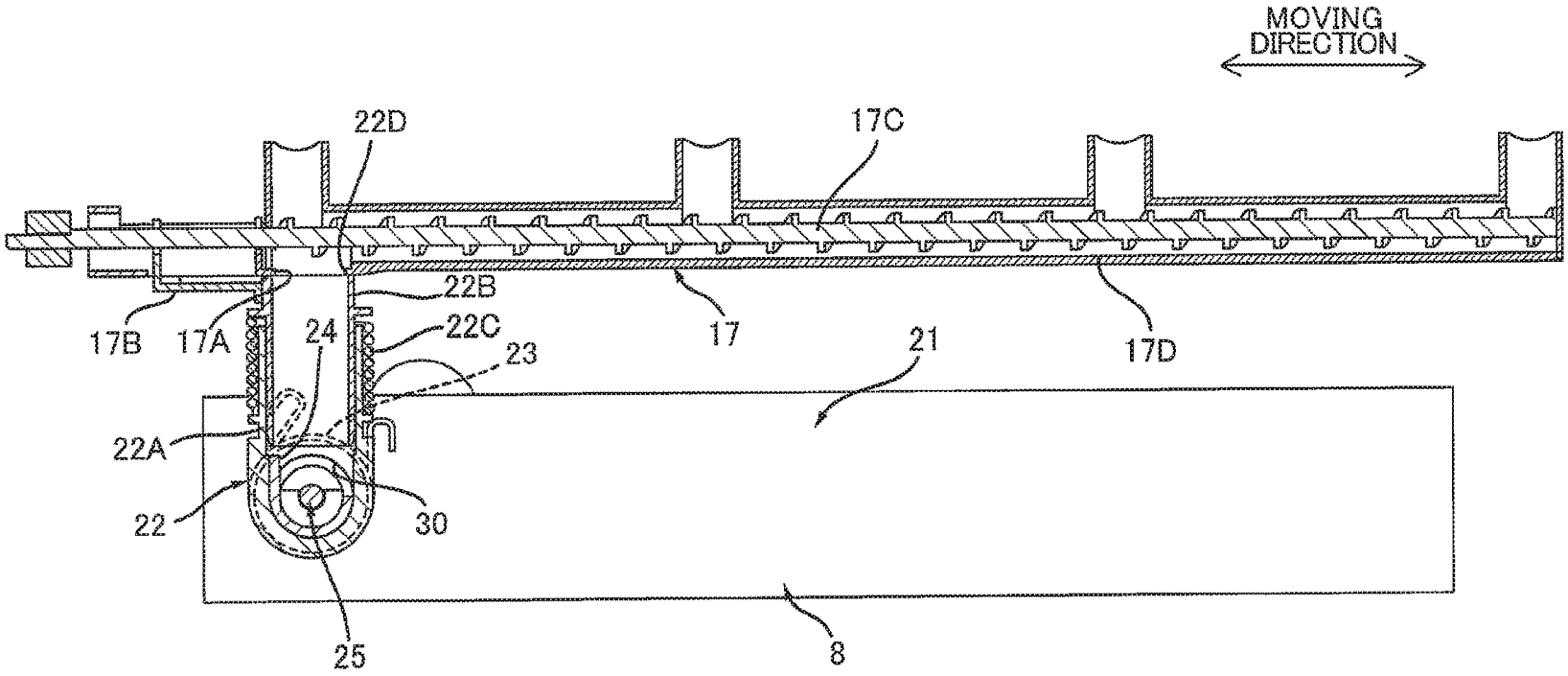
FIG. 5 is a view for describing movement of the guide pipe during movement of the drum unit from its internal position to its external position, and particularly illustrating a state where the drum unit is at its internal position, a shutter of a waste-toner conveyer tube is at its open position, and the guide pipe is shrunk in the image-forming apparatus according to the embodiment.

The waste-toner conveyer tube 17 extends in the moving direction. As illustrated in FIG. 5, the waste-toner conveyer tube 17 includes a tube body 17D formed with a discharge opening 17A, a shutter 17B, and a screw 17C. Waste toner in the tube body 17D can be discharged through the discharge opening 17A. The shutter 17B is movable relative to the tube body 17D in an extending direction of the waste-toner conveyer tube 17 (i.e., in the moving direction) between an open position (FIG. 5) where the shutter 17B opens the discharge opening 17A and a closed position (FIG. 7) where the shutter 17B closes the discharge opening 17A. The shutter 17B is urged in a direction from the open position toward the closed position by a spring (not illustrated). The screw 17C is positioned inside the tube body 17D, and extends in the extending direction of the tube body 17D (i.e., in the moving direction). The screw 17C is configured to convey the waste toner in the tube body 17D toward the discharge opening 17A.

1.4 Exposure Device 5

The exposure device 5 is configured to expose the plurality of photosensitive drums 11Y, 11M, 11C and 11K to light. The exposure device 5 is positioned above the drum unit 4 at the internal position. In the present embodiment, the exposure device 5 is a laser scan unit.

1.5 Developing Cartridge 6Y, 6M, 6C, 6K

Each of the plurality of developing cartridges 6Y, 6M, 6C and 6K is attachable to and detachable from the drum unit 4 in a state where the drum unit 4 is at its external position. When attached to the drum unit 4, the developing cartridges 6Y, 6M, 6C and 6K are arrayed in the moving direction so as to be spaced away from one another.

The developing cartridge 6Y stores toner to be supplied to the photosensitive drum 11Y. The developing cartridge 6Y includes the developing roller 14Y.

The developing roller 14Y is configured to supply the toner stored in the developing cartridge 6Y to the photosensitive drum 11Y. The electrostatic latent image formed on the photosensitive drum 11Y is developed by supplying toner in the developing cartridge 6Y to the photosensitive drum 11Y, to form a toner image on the peripheral surface of the photosensitive drum 11Y. In other words, the toner image is formed on the peripheral surface of the photosensitive drum 11Y by electrostatically moving the toner from the developing roller 14Y to the photosensitive drum 11Y, thereby developing the electrostatic latent image on the photosensitive drum 11Y. A portion of the developing roller 14Y is accommodated inside the developing cartridge 6Y. In a state where the developing cartridge 6Y is attached to the drum unit 4, the developing roller 14 is in contact with the peripheral surface of the photosensitive drum 11Y.

Note that, the developing cartridge 6M accommodates therein toner to be supplied to the photosensitive drum 11M, and includes a developing roller 14M. The developing cartridge 6C accommodates therein toner to be supplied to the photosensitive drum 11C, and includes a developing roller 14C. The developing cartridge 6K accommodates therein toner to be supplied to the photosensitive drum 11K, and includes a developing roller 14K. The developing cartridges 6M, 6C, 6K have the same structure and functions as the developing cartridge 6Y. Therefore, descriptions on the developing cartridges 6M, 6C and 6K will be omitted here.

1.6 Transfer Unit 7

The transfer unit 7 is attachable to and detachable from the housing 2 in a state where the transfer unit 7 is attached to the housing 2 and the drum unit 4 is at the internal position, the transfer unit 7 is positioned below the plurality of photosensitive drums 11Y, 11M, 11C and 11K. The transfer unit 7 includes a belt 15. The belt 15 is in contact with each of the plurality of photosensitive drums 11Y, 11M, 11C and 11K in the state where the transfer unit 7 is attached to the housing 2 and the drum unit 4 is at the internal position. The belt 15 is configured to convey each sheet S supplied from the sheet supply portion 3 toward the fixing device 9. The transfer unit 7 transfers each toner image formed on each of the photosensitive drums 11Y, 11M, 11C and 11K to the sheet S while the sheet S conveyed by the belt 15 contacts each of the photosensitive drums 11Y, 11M, 11C and 11K.

1.7 Waste Toner Container 8

The waste toner container 8 is attachable to and detachable from the housing 2. When attached to the housing 2, the waste toner container 8 is configured to receive waste toner collected by each of the plurality of the drum cleaning members 13Y, 13M, 13C and 13K. In a state where the waste toner container 8 is attached to the housing 2 and the drum unit 4 is at its internal position, the waste toner container 8 is connected to the waste-toner conveyer tube 17. The waste toner collected by each of the plurality of the drum cleaning members 13Y, 13M, 13C and 13K is received in the waste toner container 8 through the waste-toner conveyer tube 17.

The waste toner container 8 includes a belt cleaning member 16 for cleaning the belt 15 of the transfer unit 7. The belt cleaning member 16 is in contact with the belt 15 in a state where the transfer unit 7 and the waste toner container 8 are attached to the housing 2. In the attached state of the waste toner container 8 to the housing 2, the belt cleaning member 16 is configured to clean the belt 15 and the waste toner container 8 receives the waste toner collected by the belt cleaning member 16.

1.8 Fixing Device 9

The fixing device 9 is configured to fix the toner image to the sheet S by heating and pressing the sheet S onto which the toner image is transferred. The sheet S moving past the fixing device 9 is then discharged onto an upper surface of the housing 2. Detailed Structure of Waste Toner Container 8

Now, the waste toner container 8 will be described in detail with reference to FIGS. 1, 3 to 4B.

Figure 3:
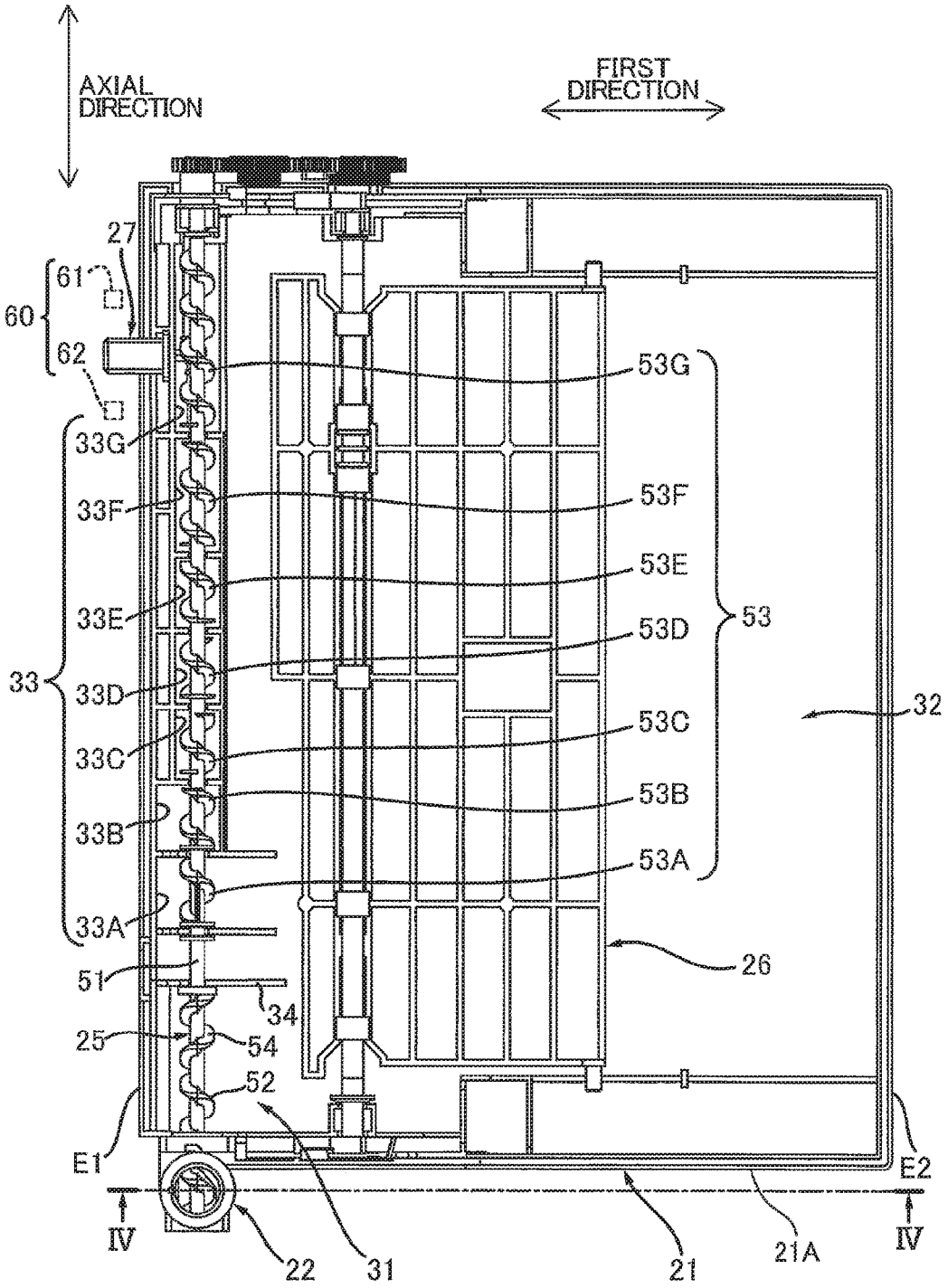
FIG. 3 is a plan view illustrating an internal structure of a waste toner container according to the embodiment.
Figure 4A:
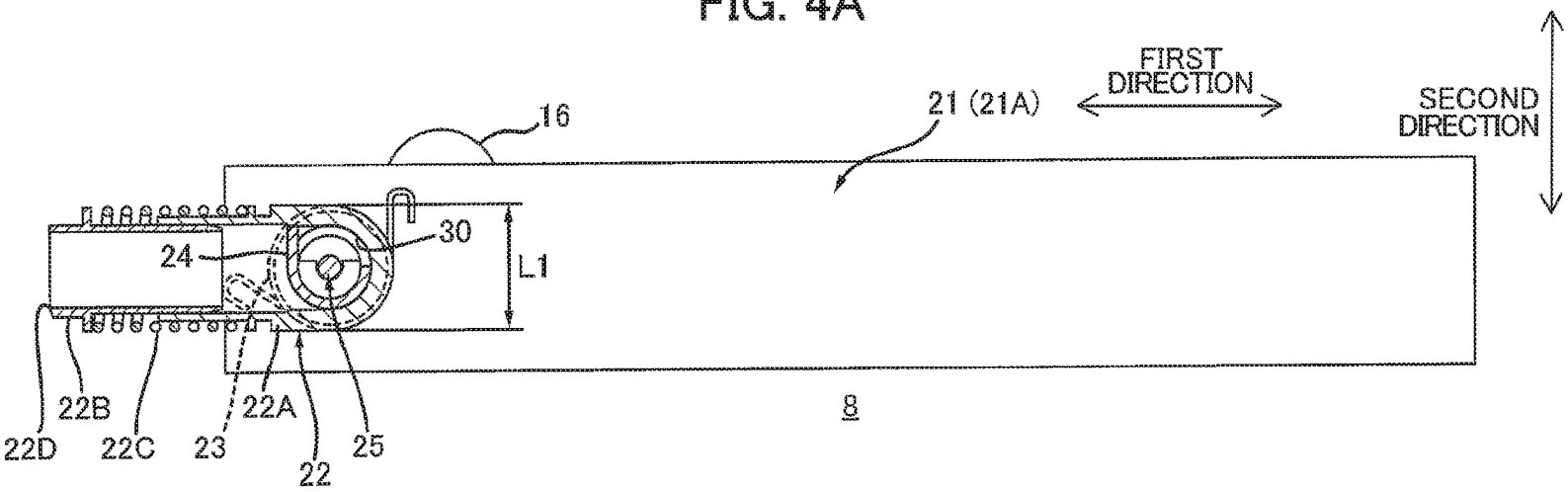
FIG. 4A is a cross-sectional view taken along a line IV-IV in FIG. 3 illustrating a guide pipe at its first position in the image-forming apparatus according to the embodiment.
Figure 4B:
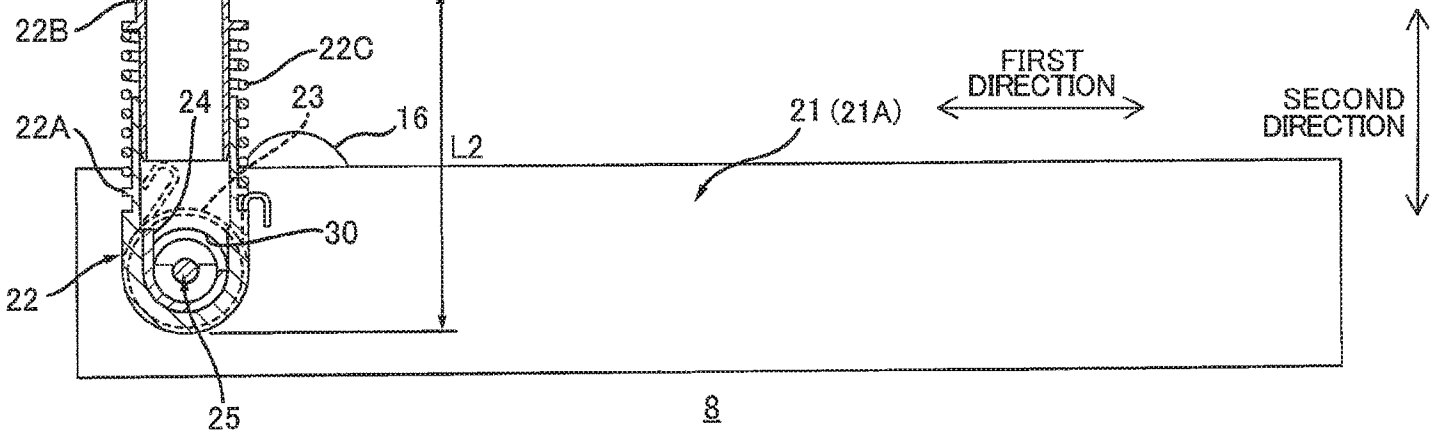
FIG. 4B is a cross-sectional view taken along the line IV-IV in FIG. 3 illustrating the guide pipe at its second position in the image-forming apparatus according to the embodiment.

As illustrated in FIGS. 3 to 4B, the waste toner container 8 further includes a casing 21, the guide pipe 22, a spring 23, a shutter, a screw 25, a conveying member 26, and a detecting portion 27.

2.1 Casing 21

The casing 21 is adapted to store waste toner therein. As illustrated in FIG. 1, the easing 21 extends in the moving direction and widthwise direction in the state where the waste toner container 8 is attached to the housing 2. The casing 21 has a first end portion E1 and a second end portion E2 in the moving direction. In the attached state of the waste toner container 8 to the housing 2, the second end portion E2 is positioned opposite to the opening 2A of the housing 2 with respect to the first end portion E1.

In the following description with respect to the waste toner container 8, as illustrated in. FIGS. 3 to 4B, a direction connecting the first end portion E1 to the second end portion E2 of the casing 21 will be referred to as "first direction". That is, the "first direction" is coincident with the "moving direction" in the attached state of the waste toner container 8 to the housing 2. Further, a direction in which a rotation axis of the screw 25 extends will be referred to as "axial direction". The "axial direction" is the same as the "widthwise direction" in the attached state of the waste toner container 8 to the housing 2. Further, a direction crossing the axial direction and the first direction will be referred to as "second direction". The "second direction" is the same as "up-down direction" in the attached state of the waste toner container 8 to the housing 2.

As depicted in FIGS. 4A and 4B, an opening 30 is formed in the casing 21. The easing 21 includes a first accommodating portion 31, a second accommodating portion 32, a third accommodating portion 33, and a guide wall 34.

2.1.1 Opening 30

As illustrated in FIG. 4A, the opening 30 is formed in a side wall 21A of the casing 21. The side wall 21A is a wall constituting one end of the casing 21 in the axial direction. The opening 30 is in communication with the first accommodating portion 31 (FIG. 3).

2.1.2 First Accommodating Portion 31

The first accommodating portion 31 is adapted to receive waste toner conveyed from the guide pipe 22 through the opening 30. As illustrated in FIG. 3, the first accommodating portion 31 is positioned between the guide pipe 22 and the guide wall 34 in the axial direction. The first accommodating portion is in communication with the guide pipe 22 through the opening 30.

2.1.3 Second Accommodating Portion 32

The second accommodating portion 32 is adapted to receive the waste toner flowing from the first accommodating portion 31. As illustrated in FIG. 3, the second accommodating portion 32 is aligned with the first accommodating portion 31 in the first direction, and is in communication with the first accommodating portion 31. The second accommodating portion 32 is aligned with the detecting portion 27 with a space therebetween in a direction crossing the axial direction. More precisely, the second accommodating portion 32 is aligned with the detecting portion 27 with a space therebetween in the first direction. Hence, the waste toner in the second accommodating portion 32 does not affect operations of the detecting portion 27.

2.1.4 Third Accommodating Portion 33

The third accommodating portion 33 is adapted to receive the waste toner flowing from the second accommodating portion 32. The third accommodating portion 33 is aligned with the second accommodating portion 32 in the first direction, and is in communication with the second accommodating portion 32. The third accommodating portion 33 is aligned with the first accommodating portion 31 with a space therebetween in the axial direction. The guide wall 34 is positioned between the third accommodating portion 33 and the first accommodating portion 31 in the axial direction. The third accommodating portion 33 includes a plurality of accommodation chambers 33A, 33B, 33C, 33D, 33E, 33F and 33G. Hence, the third accommodating portion 33 is less likely to be fully filled with waste toner before the second accommodating portion 32 becomes completely full of waste toner.

The plurality of accommodation chambers 33A, 33B, 33C, 33D, 33E, 33F and 33G are aligned with one another in the axial direction. The accommodation chamber 33A is positioned between the accommodation chamber 33B and the guide wall 34 in the axial direction. The accommodation chamber 33A is adapted to receive waste toner flowing from the second accommodating chamber 32. The accommodation chamber 33B is positioned between the accommodation chamber 33A and the accommodation chamber 33C in the axial direction. The accommodation chamber 33B is adapted to receive waste toner flowing from the accommodation chamber 33A. The accommodation chamber 33C is positioned between the accommodation chamber 33D and the accommodation chamber 33B in the axial direction. The accommodation chamber 33C is adapted to receive waste toner flowing from the accommodation chamber 33B. The accommodation chamber 33D is positioned between the accommodation chamber 33C and the accommodation chamber 33E in the axial direction. The accommodation chamber 33D is adapted to receive waste toner flowing from the accommodation chamber 33C. The accommodation chamber 33E is positioned between the accommodation chamber 33D and the accommodation chamber 33F in the axial direction. The accommodation chamber 33E is adapted to receive waste toner flowing from the accommodation chamber 33D. The accommodation chamber 33F is positioned between the accommodation chamber 33E and the accommodation chamber 33G in the axial direction. The accommodation chamber 33F is adapted to receive waste toner flowing from the accommodation chamber 33E. The accommodation chamber 33G is adapted to receive waste toner flowing from the accommodation chamber 33F.

The accommodation chambers 33A, 33B, 33C, 33D, 33E and 33F are positioned between the guide wall 34 and the detecting portion 27 in the axial direction. That is, the third accommodating portion 33 is positioned between the guide wall 34 and the detecting portion 27 in the axial direction. The accommodation chamber 33G is positioned between the detecting portion 27 and the second accommodating portion 32 in the first direction. The accommodation chamber 33G is in communication with the detecting portion 27.

2.1.5 Guide Wall 34

The guide wall 34 prevents the waste toner in the first accommodating portion 31 from flowing into the third accommodating portion 33, and guides the waste toner in the first accommodating portion 31 toward the second accommodating portion 32. The guide wall 34 is positioned between the first accommodating portion 31 and the third accommodating portion 33 in the axial direction. In other words, the guide wall 34 is positioned between the first accommodating portion 31 and the third accommodating portion 33 in the extending direction of the screw 25. The guide wall 34 extends in the first direction.

The guide wall 34 is positioned opposite to the detecting portion 27 with respect to the accommodation chambers 33A-33F in the axial direction. That is, the guide wall 34 is positioned opposite to the detecting portion 27 with respect to the accommodation chambers 33A-33F in the extending direction of the screw 25. The guide wall 34 is positioned closer to the guide pipe 22 than the detecting portion 27 is to the guide pipe 22 in the axial direction. Hence, the third accommodating portion 33 can have a sufficient length in the axial direction, which suppress waste toner from flowing into the detecting portion 27 through the third accommodating portion 33 (accommodation chambers 33A-33G) before the second accommodating portion 32 becomes completely filled with waste toner.

2.2 Guide Pipe 22

The guide pipe 22 is configured to guide waste toner to the casing 21. Specifically, the guide pipe 22 guides the waste toner from the waste-toner conveyer tube 17 toward the casing 21 in the state where the drum unit 4 is at the internal position. The guide pipe 22 is hollow cylindrical in shape. Specifically, as illustrated in FIG. 4A, the guide pipe 22 includes a first pipe 22A, a second pipe 22B, and a spring 22C.

The first pipe 22A is connected to the easing 21. Specifically, the first pipe 22A is connected to the side wall 21A of the casing 21. Hence, the guide pipe 22 is connected to the casing 21. The first pipe 22A has a hollow cylindrical shape whose internal space is in communication with the first accommodating portion 31 through the opening 30.

The first pipe 22A is pivotally movable relative to the casing 21. Thus, the guide pipe 22 is pivotally movable relative to the casing 21 between a first position (FIG. 4A) and a second position (FIG. 4B). In a state where the guide pipe 22 is at the first position, the first pipe 22A extends in the first direction. That is, the guide pipe 22 extends in the first direction at the first position. The guide pipe 22 at the first position defines a length L1 in the second direction that is smaller than a length L2 of the guide pipe 22 at the second position in the second direction. The first pipe 22A has an outer diameter that is smaller than a length of the casing 21 in the second direction. Therefore, in the state where the guide pipe 22 is at the first position, the first pipe 22A does not protrude farther than the casing 21 in the second direction. Further, in a state where the guide pipe 22 is at the second position, the first pipe 22A extends in the second direction. That is, the guide pipe 22 extends in the second direction at its second position. Further, in the state where the guide pipe 22 is at the second position, a longitudinal dimension of the first pipe 22A. (a length of the first pipe 22A in an extending direction of the first pipe 22A) is greater than the length of the casing 21 in the second direction. Therefore, the guide pipe 22 protrudes farther than the casing 21 in the second direction at the second position of the guide pipe 22.

The second pipe 22B is positioned inside the first pipe 22A in a radial direction of the first pipe 22A. The second pipe 22B protrudes from the first pipe 22A in the extending direction of the first pipe 22A. The second pipe 22B is hollow cylindrical in shape. Since each of the first pipe 22A and the second pipe 22B has a cylindrical-shaped cross-section, clogging of waste toner to inner peripheral surfaces of these pipes can be restrained, compared to a case where these pipes 22A and 22B have a polygonal-shaped cross-section. Further, since the first pipe 22A and the second pipe 22B are cylindrical, the spring 22C (a coil spring, for example) can be easily disposed over the first pipe 22A. The second pipe 22B is slidably movable relative to the first pipe 22A in the extending direction of the first pipe 22A. Specifically, the guide pipe 22 can expand and contract (shrink) in the extending direction of the guide pipe 22 because of the slidability of the second guide pipe 22B relative to the first pipe 22A. Incidentally, the extending direction of the guide pipe 22 is the same as the extending direction of the first pipe 22A. The second pipe 22B has an inlet opening 22D. That is, the guide pipe 22 has the inlet opening 22D.

The inlet opening 22B is formed in, a distal end of the second pipe 22B in the extending direction of the first pipe 22A. Specifically, in the extending direction of the first pipe 22A. The second pipe 22B has one end positioned inside the first pipe 22A and another end positioned outside of the first pipe 22A. The inlet opening 22D is positioned at the other end of the second pipe 22B. The inlet opening 22D is in communication with the discharge opening 17A (FIG. 5) of the waste-toner conveyer tube 17 in the state where the waste toner container 8 is attached to the housing 2 and the drum unit 4 is at the internal position. Waste toner from the waste-toner conveyer tube 17 can be introduced into the second pipe 22B through the inlet opening 22D and the discharge opening 17A.

The spring 22C urges the second pipe 22B in a direction away from the first pipe 22A in the extending direction of the first pipe 22A. In other words, the spring 22C urges the second pipe 22B in a direction for expanding the guide pipe 22. That is, the spring 22C urges the second pipe 22 toward the waste-toner conveyer tube 17 in the state where the waste toner container 8 is attached to the housing 2 and the drum unit 4 is at the internal position. Hence, the guide pipe 22 can expand with the second pipe 22B applying pressing force to the discharge opening 17A of the waste toner conveying tube 17 during movement of the drum unit 4 from the internal position to the external position. Consequently, leakage of waste toner can be prevented. The spring 22C is a coil spring disposed over the first pipe 22A. In the extending direction of the first pipe 22A, the spring 22C has one end seated on the first pipe 22A, and has another end seated on the second pipe 22B.

2.3 Spring 23

The spring 23 urges the guide pipe 22 to pivotally move from the second position (FIG. 4B) toward the first position (FIG. 4A). The spring 23 is a torsion spring, for example. The spring 23 has one end portion in contact with the casing 21. The one end portion of the spring 23 is fixed to the casing 21. The spring 23 has another end portion in contact with the first pipe 22A. The other end portion of the spring 23 is fixed to the first pipe 22A.

The guide pipe 22 is pivotally moved from the second position to the first position by an urging three of the spring 23 at the time of detachment of the waste toner container 8 from the housing 2.

Figure 8:
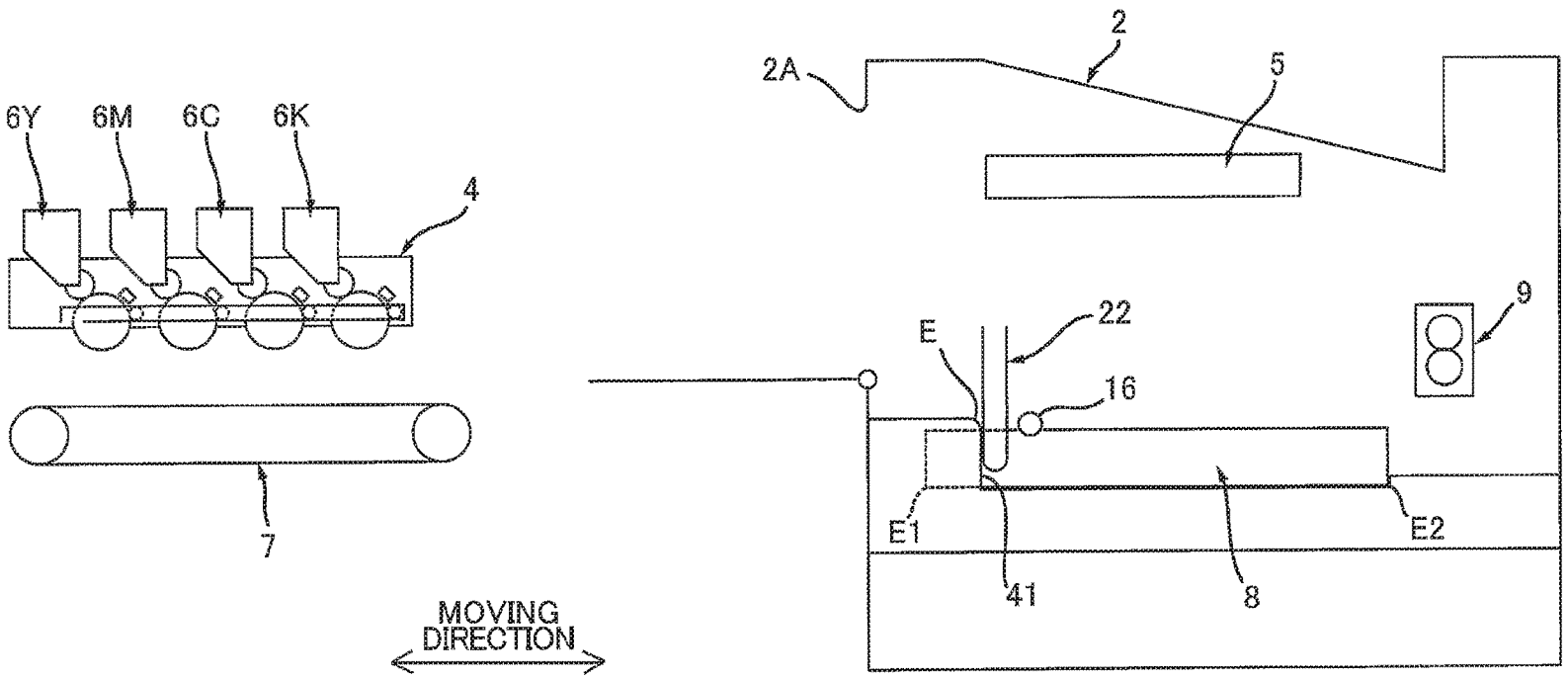
FIG. 8 is a view for describing detachment of the waste toner container from a housing of the image-forming apparatus, and particularly illustrating a state where the waste toner container is attached to the housing, and the guide pipe is at the second position in the image-forming apparatus according to the embodiment.
Figure 9:
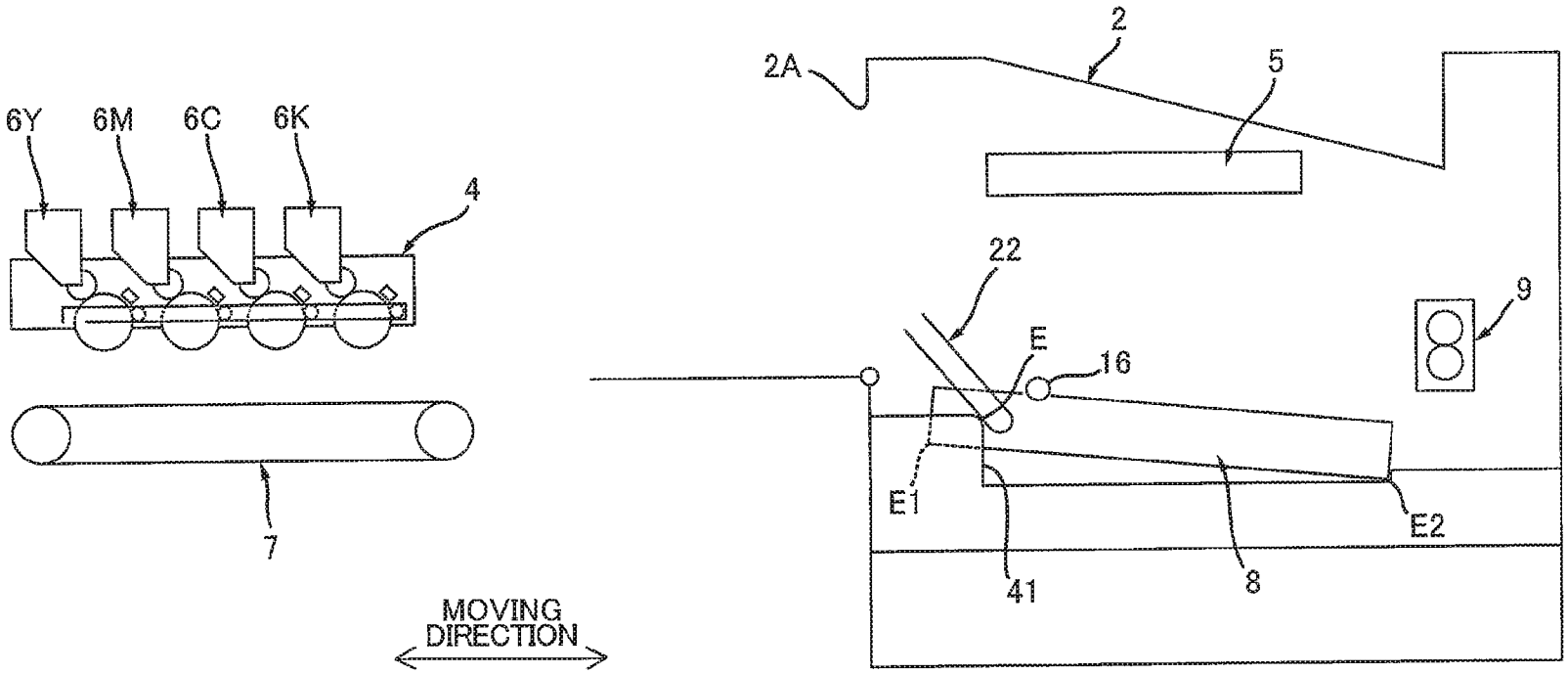
FIG. 9 is a view subsequent to the state in FIG. 8 for describing the detachment of the waste toner container from the housing of the image-forming apparatus, and particularly illustrating a state where a first end portion of the waste toner container is lifted upward, and the guide pipe is moving from the second position toward the first position in the image-forming apparatus according to the embodiment.

Further, the guide pipe 22 is pivotally moved from the first position to the second position against the urging force of the spring 23 at the time of attachment of the waste toner container 8 to the housing 2. Specifically, as depicted in FIG. 8, a groove 41 is formed in the housing 2, and the guide pipe 22 is fitted with the groove 41 in the attached state of the waste toner container 8 to the housing 2. That is, the housing 2 has the groove 41 with which the guide pipe 22 positioned at the second position can be fitted in the attached state of the waste toner container 8 to the housing 2. The guide pipe 22 is pivotally moved from the first position to the second position by contacting an edge E of the groove 41, as illustrated in FIG. 9, while the guide pipe 22 is being fitted with the groove 41.

2.4 Shutter 24

As illustrated in FIG. 4A, the shutter 24 is provided at the side wall 21A of the casing 21. Specifically, the shutter 24 is provided at an edge defining the opening 30 formed in the side wall 21A of the casing 21. The shutter 24 protrudes from an outer surface of the side wall 21A of the casing 21 into the internal space of the first pipe 22A. The shutter 24 extends in the second direction.

The shutter 24 is movable relative to the guide pipe 22 in accordance with movement of the guide pipe 22 between the first position and the second position. More specifically, the shutter 24 is positioned between the inlet opening 22D and the opening 30 in the first direction in the state where the guide pipe 22 is at the first position. Thus, in the first position of the guide pipe 22, the shutter 24 closes off the internal space of the guide pipe 22. In the state where the guide pipe 22 is at the second position, as illustrated in FIG. 4B, the shutter 24B is not positioned between the inlet opening 22D and the opening 30 in the second direction. Hence, the shutter 24 does not block the internal space of the guide pipe 22 and allows the internal space of the guide pipe 22 to communicate with the first accommodating portion 31 of the easing 21 through the opening 30. Incidentally, the shutter 24 has a profile in conformance with an inner peripheral surface of the first pipe 22A in the state where the guide pipe 22 is at the second position.

2.5 Screw 25

As illustrated in FIG. 3, the screw 25 is positioned at interiors of the first accommodating portion 31 and the third accommodating portion 33. The screw 25 extends in the axial direction. The screw 25 includes a shaft 51, a first fin 52, a second fin 53, and a third fin 54.

The shaft 51 extends in the axial direction, and is positioned at the interiors of the first accommodating portion 31 and the third accommodating portion 33. The shaft 51 is columnar in shape.

The first fin 52 is configured to convey the waste toner flowing from the guide pipe 22 into the first accommodating portion 31. That is, the screw 25 is configured to convey the waste toner conveyed from the guide pipe 22 into the casing 21. The first fin 52 has a part positioned inside the first pipe 22A (see FIG. 4A) and another part positioned inside the first accommodating portion 31. The first fin 51 is provided over the shaft 51 and protrudes from a peripheral surface of the shaft 51. The first fin 51 helically extends along the peripheral surface of the shaft 51.

The second fin 53 is configured to convey the waste toner flowing into the third accommodating portion 33 from the second accommodating portion 32 toward the detecting portion 27. The second fin 53 is positioned inside the third accommodating portion 33. The second fin 53 is provided over the shaft 51. The second fin 53 includes a plurality of fins 53A, 53B, 53C, 53D, 53E, 53F and 53G. These fins 53A, 53B, 53C, 53D, 53E, 53F and 53G protrude from the peripheral surface of the shaft 51 and helically extend along the peripheral surface of the shaft 51. In other words, the second fin 53 is helical in shape.

The fin 53A is positioned in the accommodation chamber 33A and is configured to convey the waste toner in the accommodation chamber 33A toward the accommodation chamber 33B. The fin 53B is positioned in the accommodation chamber 33B and is configured to convey the waste toner in the accommodation chamber 33B toward the accommodation chamber 33C. The fin 53C is positioned in the accommodation chamber 33C and is configured to convey the waste toner in the accommodation chamber 33C toward the accommodation chamber 33D. The fin 53D is positioned in the accommodation chamber 33D and is configured to convey the waste toner in the accommodation chamber 33D toward the accommodation chamber 33E. The fin 53E is positioned in the accommodation chamber 33B and is configured to convey the waste toner in the accommodation chamber 33E toward the accommodation chamber 33F. The fin 53F is positioned in the accommodation chamber 33F and is configured to convey the waste toner in the accommodation chamber 33F toward the accommodation chamber 33G. The fin 53G is positioned in the accommodation chamber 33G and is configured to convey the waste toner in the accommodation chamber 33G in a direction away from the accommodation chamber 33F.

The third fin 54 is accommodated in the first accommodating portion 31. The third fin 54 is positioned between the first fin 52 and the guide wall 34 in the axial direction. The third fin 54 is configured to restrain waste toner conveyed by the first fin 52 from flowing toward the guide wall 34. The third fin 54 is configured to convey waste toner in a direction opposite to a conveying direction of the first fin 52. The third fin 54 protrudes from the peripheral surface of the shaft 51 and helically extends along the peripheral surface of the shaft 51. In other words, the third fin 54 is helical in shape.

2.6 Conveying Member 26

The conveying member 26 is positioned in the second accommodating portion 32, and extends in the axial direction. The conveying member 26 has a conventional structure including: a crank shaft extending in the axial direction; and a grid-like member movable in conjunction with rotation of the crank shaft. The detailed structure of the conveying member 26 is described in US Patent Application Publication No. 2009/0220257 A, which is incorporated therein by reference.

The conveying member 26 is configured to convey the waste toner conveyed into the casing 21 by the screw 25 in a direction crossing the axial direction. Specifically, the conveying member 26 is configured to convey the waste toner conveyed into the first accommodating portion 31 by the screw 25 and flowing into the second accommodating portion 32 from the first accommodating portion 31 in the first direction and away from the screw 25. The conveying member 26 is configured to move upward and then downward while the conveyer member 26 approaches the screw 25, and then the conveying member 26 moves away from the screw 25 during downward movement of the conveyer member 26. The conveying member 26 conveys the waste toner flowing from the first accommodating portion 31 into the second accommodating portion 32 in the direction away from the screw 25.

2.7 Detecting Portion 27

The detecting portion 27 is configured to detect that the casing 21 is full of waste toner. Specifically, a sensor 60 is provided at the housing 2 for detecting waste toner having flowed in the detecting portion 27. The sensor 60 includes: a light-emitting element 61 configured to emit light toward the detecting portion 27 (an LED, for example); and a light-receiving element 62 configured to receive the light passing through the detecting portion 27 (a photo transistor, for example).

The detecting portion 27 is made of a material that allows the light emitted by the light-emitting element 61 to pass through the detecting portion 27. The detecting portion 27 defines a space therein for accommodating waste toner. This space inside the detecting portion 27 is in communication with the accommodation chamber 33G of the third accommodating portion 33. The waste toner is thus allowed to flow into the space of the detecting portion 27 from the accommodation chamber 336.

In a state where waste toner is not accommodated in the space of the detecting portion 27, the light emitted from the light-emitting element 61 passes through the detecting portion 27. Hence, the light-receiving element 62 receives the light emitted from the light-emitting element 61, thereby detecting the light of the light-emitting element 61. On the other hand, in a state where waste toner flows into and is stored in the space inside the detecting portion 27, the light emitted from the light-emitting element 61 cannot pass through the detecting portion 27 since the waste toner inside the detecting portion 27 interrupts passage of the light from the light-emitting element 61. Hence, the light-receiving element 62 cannot receive the light emitted from the light-emitting element 61, and, hence, is unable to detect the light of the light-emitting element 61.

A controller (not illustrated) provided in the housing 2 is configured to detect whether the casing 21 is full of waste toner based on whether the light-receiving element 62 receives the light emitted by the light-emitting element 61, that is, based on whether the light of the light-emitting element 61 is blocked by the waste toner stored in the detecting portion 27. As described earlier, since the third accommodating portion 33 can have a sufficient length in the axial direction, waste toner is restrained from flowing into the detecting portion 27 through the third accommodating portion 33 (accommodation chambers 33A-33G) before the second accommodating portion 32 becomes completely filled with waste toner. Hence, the sensor 60 is less likely to erroneously determine that the second accommodating portion 32 is full of waste toner although room remains for storing waste toner in the second accommodating portion 32.

3. Detachment of the Waste Toner Container 8 from the Housing 2

Next, how the waste toner container 8 is detached from the housing 2 will next be described with reference to FIGS. 2 and 5 through 10.

Figure 2:
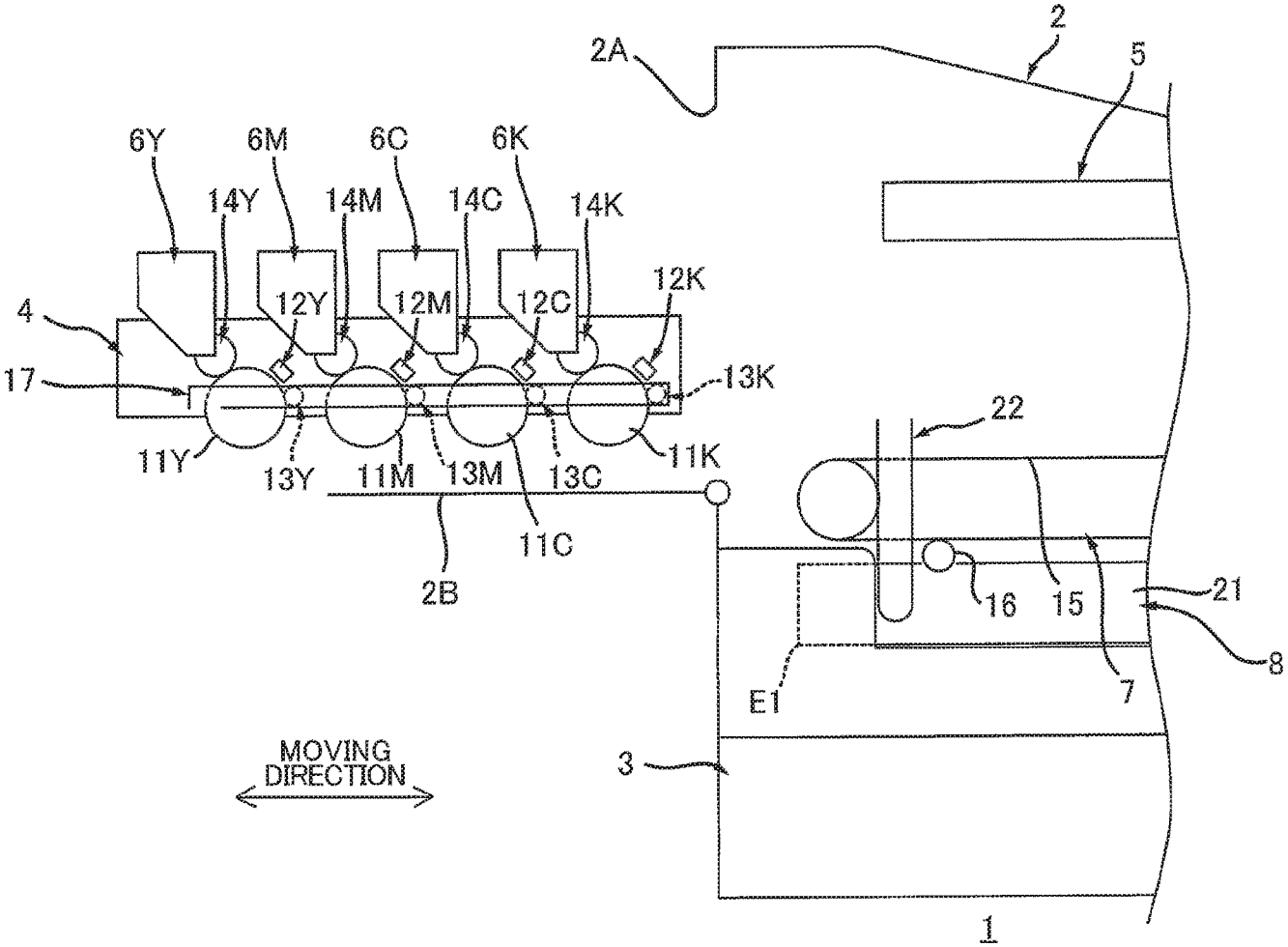
FIG. 2 is a partial schematic view illustrating an external position of a drum unit in the image-forming apparatus according to the embodiment.

In order to detach the waste toner container 8 from the housing 2, a user opens the cover 2B and moves the drum unit 4 from the internal position toward the external position, as illustrated in FIG. 2.

Figure 6:
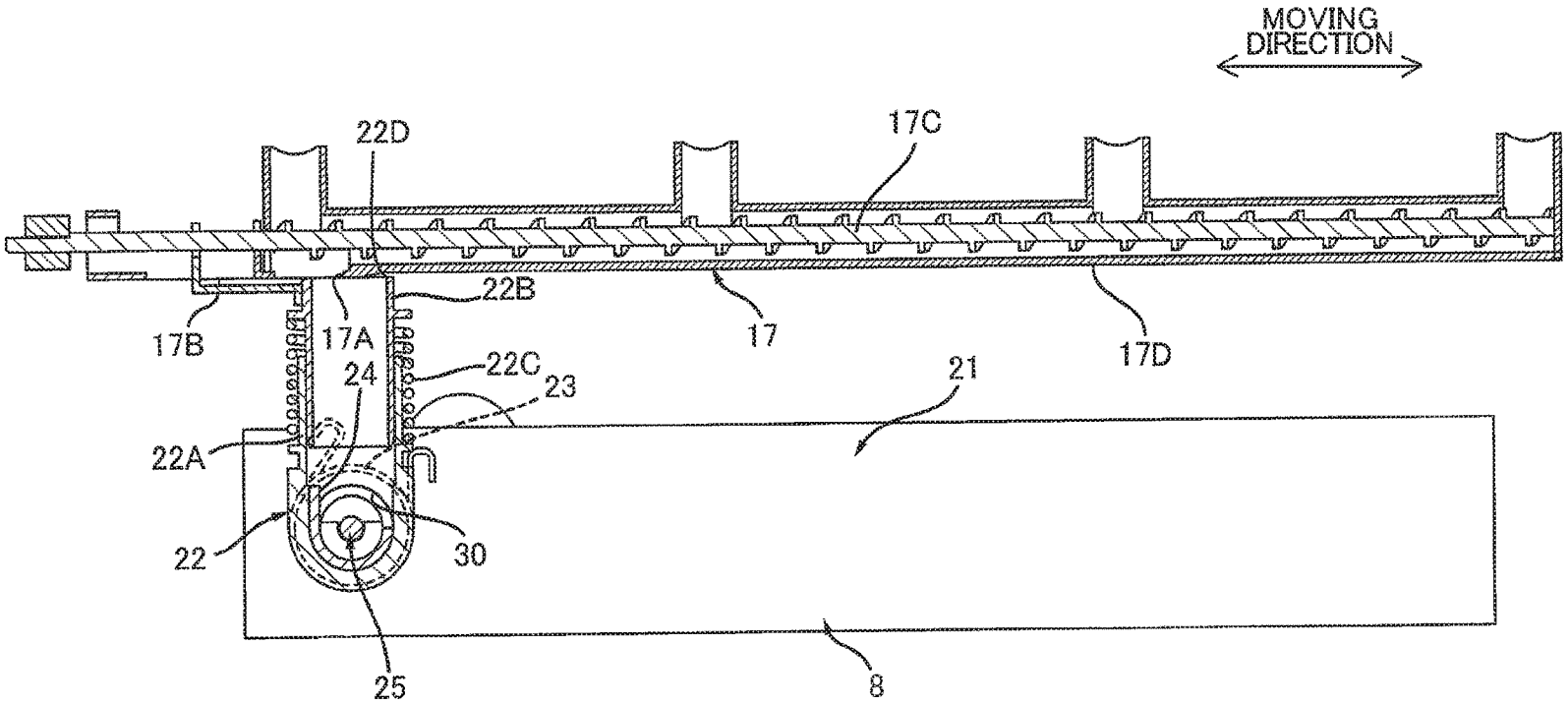
FIG. 6 is a view for describing the movement of the guide pipe during the movement of the drum unit from its internal position to its external position subsequent to the state illustrated in FIG. 5, and particularly illustrating a state where the drum unit has started moving from its internal position to its external position, the shutter of the waste-toner conveyer tube moves from its open position toward its closed position, and the guide pipe expands in the image-forming apparatus according to the embodiment.
Figure 7:
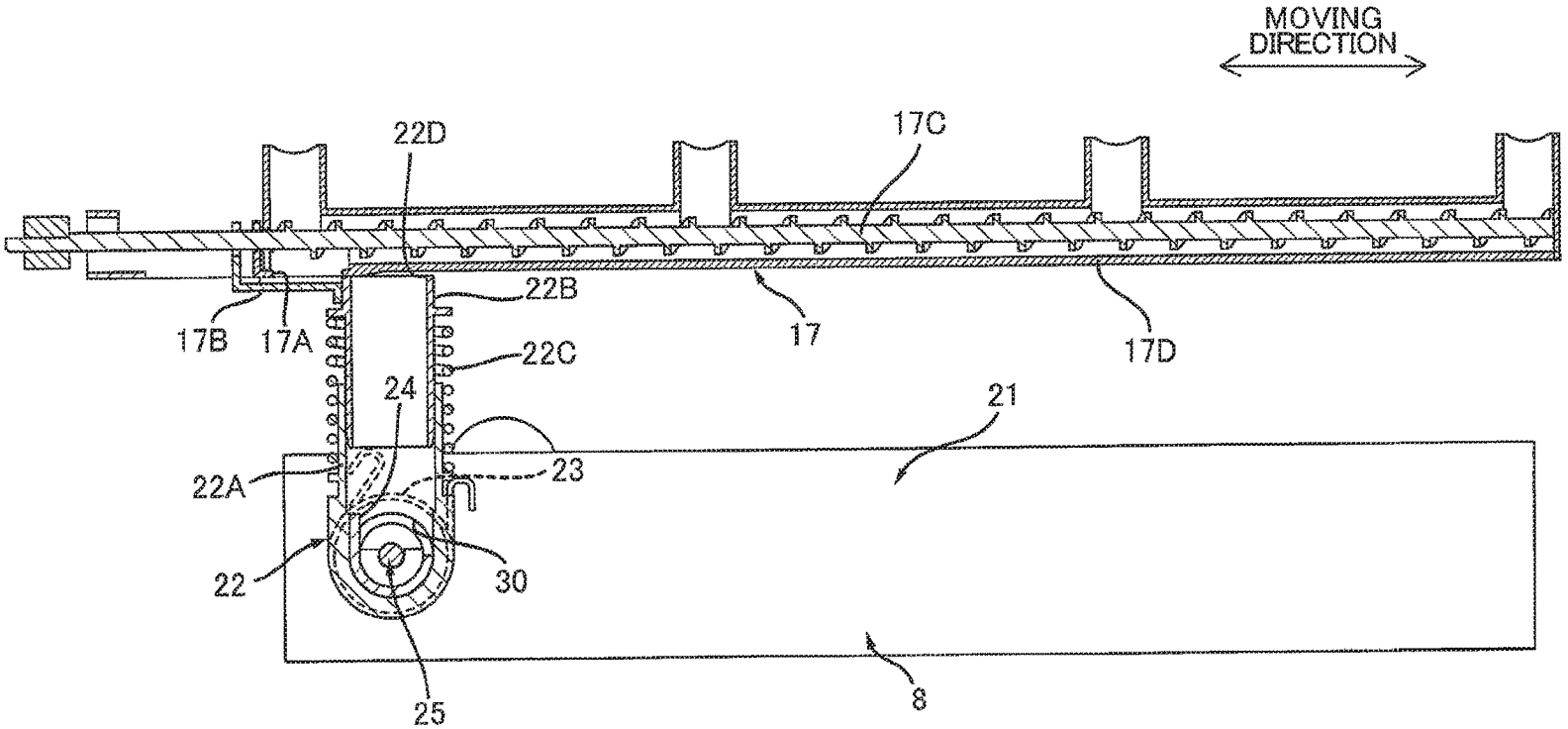
FIG. 7 is a view for describing the movement of the guide pipe during the movement of the drum unit from its internal position to its external position subsequent to the state illustrated in FIG. 6, and particularly illustrating a state where the drum unit has further moved toward its external position, the shutter of the waste-toner conveyer tube has moves further toward its closed position, and the guide pipe further expands in the image-forming apparatus according to the embodiment.

At this time, the drum unit 4 moves obliquely relative to the waste toner container 8. Specifically, as depicted in FIGS. 5 to 7, the drum unit 4 approaches the opening 2A (FIG. 2) of the housing 2 while being separated from the waste toner container 8 upward.

As a result, the second pipe 22B of the guide pipe 22 moves upward relative to the first pipe 22A by the urging force of the spring 22C in accordance with the upward movement of the drum unit 4. That is, the guide pipe 22 expands upward in accordance with the upward movement of the drum unit 4. Hence, the second pipe 22B of the guide pipe 22 maintains contact with the shutter 17B of the waste-toner conveyer tube 17 during upward movement of the drum unit 4.

Further, as the drum unit 4 moves toward the opening 2A, the shutter 17B of the waste-toner conveyer tube 17 moves from its open position toward its closed position by the urging force of the spring (not illustrated) while the shutter 17B maintains contact with the second pipe 22B. Accordingly, while the drum unit 4 moves from the internal position to the external position and until the shutter 17B comes to its closed position, waste toner passing through the discharge opening 17A can be received in the inlet opening 22D of the second pipe 22B or can be received on the shutter 17B. Consequently, leakage of waste toner during movement of the drum unit 4 from the internal position to the external position can be restrained.

Then, as illustrated in FIG. 8, the user takes out the drum unit 4 from the housing 2 in the state where the drum unit 4 is at the external position. The user then takes out the transfer unit 7 from the housing 2.

Figure 10:
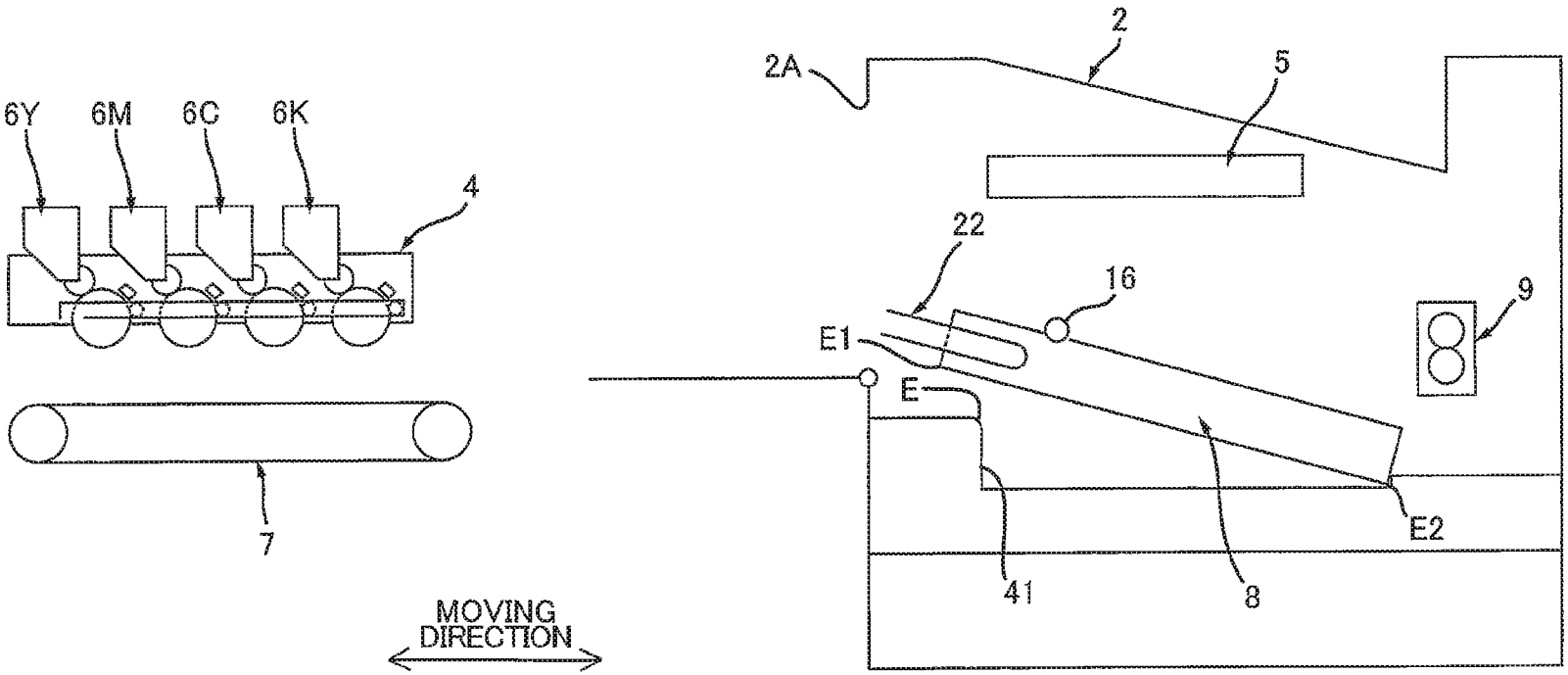
FIG. 10 is a view subsequent to the state in FIG. 9 for describing the detachment of the waste toner container from the housing of the image-forming apparatus, and particularly illustrating a state where the first end portion of the waste toner container is further lifted upward, and the guide pipe has moved to the first position in the image-forming apparatus according to the embodiment.

Thereafter, as illustrated in FIGS. 8 through 10, the user detaches the waste toner container 8 from the housing 2. At this time, the guide pipe 22 moves from the second position to the first position by the urging force of the torsion spring 23 (FIG. 4) in accordance with disengagement of the guide pipe 22 from the groove 41.

The user then pulls out the waste toner container 8 from the housing 2 through the opening 2A. Thus, detachment of the waste toner container 8 from the housing 2 is completed.

At the time of pulling out of the waste toner container 8 from the housing 2, the guide pipe 22 is at the first position as depicted in FIG. 10. That is, the length of the guide pipe 22 at the first position in up-down direction is smaller than that at the second position. Hence, collision of the guide pipe 22 against the opening 2A can be restrained during detachment of the waste toner container 8 from the housing 2.

4. Attachment of the Waste Toner Container 8 to the Housing 2

In order to attach the waste toner container 8 to the housing 2, the user inserts the waste toner container 8 into the housing 2 through the opening 2A, as illustrated in FIG. 10. At this time, the second end portion E2 of the waste toner container 8 is made in contact with part of the housing 2, thereby providing positioning of the waste toner container 8 with respect to the housing 2.

Then, as illustrated in FIG. 9, the user pushes the first end portion E1 of the waste toner container 8 downward about the second end portion E2 as a fulcrum. As a result, the waste toner container 8 is pivotally moved such that the first end portion E1 is moved downward, whereupon the guide pipe 22 is brought into contact with the edge E of the groove 41.

As the user pushes the first end portion E1 further downward, the guide pipe 22 is moved from the first position toward the second position against the urging force of the torsion spring 23 while contact en the guide pipe 22 and the edge E of the groove 41 is maintained.

The guide pipe 22 is thus located at the second position upon completion of attachment of the waste toner container 8 to the housing 2.

5. Operational and Technical Advantages

As illustrated in FIG. 10, the guide pipe 22 is at the first position at the time of attachment and detachment of the waste toner container 8 to and from the housing 2. Therefore, the length of the guide pipe 22 in the second direction (FIG. 4A) can be smaller at the first position than that at the second position (FIG. 4B).

Hence, collision of the guide pipe 22 against components in the housing 2 can be restrained during attachment and detachment of the waste toner container 8 to and from the housing 2.

Consequently, operations for attaching and detaching the waste toner container 8 relative to the housing 2 can be facilitated.

6. Modifications

According to the above-described embodiment, the first pipe 22A and the second pipe 22B of the guide pipe 22 are hollow cylindrical in shape. However, any tubular pipe having hollow polygonal shape, such as a hollow quadratic prism shape, is available as long as the tubular pipe can guide waste toner into the casing 21.

Further, the inlet opening 22D can be funnel-shaped.

While the description has been made in detail with reference to the embodiments thereof, it would be apparent to those skilled in the art that many modifications and variations may be made therein without departing from the spirit of the disclosure.

What is claimed is:

1. A waste toner container attachable to and detachable from a housing of an image-forming apparatus through an opening formed in the housing, the waste toner container comprising:

a casing configured to accommodate waste toner therein, the casing having a first end and a second end positioned opposite to the opening with respect to the first end in a state where the waste toner container is attached to the housing, a direction connecting the first end to the second end being a first direction, and a direction crossing the first direction being a second direction;

a guide pipe connected to the casing and configured to guide the waste toner into the casing, the guide pipe having an inlet opening through which the waste toner is introduced into the guide pipe, the guide pipe being pivotally movable relative to the casing between a first position and a second position, the guide pipe at the first position extending in the first direction, the guide pipe at the second position extending in the second direction, the guide pipe at the first position having a length in the second direction smaller than a length in the second direction of the guide pipe at the second position; and a shutter movable relative to the guide pipe, the shutter being configured to close off an internal space of the guide pipe at the first position, the shutter being configured to allow communication of the internal space of the guide pipe at the second position.

2. The waste toner container according to claim 1, wherein the image-forming apparatus further includes a photosensitive drum and a belt in contact with the photosensitive drum, the waste toner container further comprising a belt cleaning member in contact with the belt for cleaning the belt in the state where the waste toner container is attached to the housing.

3. The waste toner container according to claim 1, further comprising a spring configured to urge the guide pipe at the second position toward the first position.

4. The waste toner container according to claim 1, wherein the guide pipe is configured to expand and contract in an extending direction of the guide pipe.

5. The waste toner container according to claim 4, wherein the guide pipe comprises:

a first pipe connected to the casing; and a second pipe having the inlet opening and slidable relative to the first pipe in an extending direction of the first pipe, the guide pipe being configured to expand and shrink in accordance with sliding movement of the second pipe relative to the first pipe.

6. The waste toner container according to claim 5, wherein the first pipe is hollow cylindrical in shape;

wherein the second pipe is hollow cylindrical in shape, the second pipe having one end positioned within the first pipe and another end formed with the inlet opening; and wherein the guide pipe further comprises a spring urging the second pipe in the extending direction of the first pipe such that the second pipe protrudes out from the first pipe.

7. The waste toner container according to claim 5, further comprising a screw rotatable about a rotation axis extending in an axial direction, the screw being configured to rotate to convey the waste toner received in the guide pipe into the casing.

8. The waste toner container according to claim 7, further comprising a conveying member located in the casing and extending in the axial direction, the conveying member being configured to convey the waste toner conveyed into the casing by the screw in a direction crossing the axial direction.

9. An image-forming apparatus comprising:

a housing including an opening formed in the housing;

a waste toner container comprising:

a casing configured to accommodate therein waste toner, the casing having a first end and a second end positioned opposite to the opening with respect to the first end in a state where the waste toner container is attached to the housing, a direction connecting the first end to the second end being a first direction, and a direction crossing the first direction being a second direction; and a guide pipe connected to the casing and configured to guide the waste toner into the casing, the guide pipe having an inlet opening through which the waste toner is introduced into the guide pipe, the guide pipe being pivotally movable relative to the casing between a first position and a second position, the guide pipe at the first position extending in the first direction, the guide pipe at the second position extending in the second direction, the guide pipe at the first position having a length in the second direction smaller than a length in the second direction of the guide pipe at the second position;

a photosensitive drum;

a charger configured to charge a peripheral surface of the photosensitive drum;

an exposure device configured to expose the peripheral surface of the photosensitive drum to light;

a belt in contact with the peripheral surface of the photosensitive drum;

a drum cleaning member configured to clean the peripheral surface of the photosensitive drum; and a belt cleaning member configured to clean the belt, wherein the waste toner container is attachable to and detachable from the housing, the waste toner being configured to accommodate waste toner collected by the drum cleaning member and the belt cleaning member in the state where the waste toner container is attached to the housing wherein the housing is formed with a groove with which the guide pipe positioned at the second position is fitted in the state where the waste toner container is attached to the housing, and wherein the guide pipe is pivotally moved from the first position to the second position by contacting an edge of the groove during fitting of the guide pipe with the groove.

10. A waste toner container attachable to and detachable from a housing of an image-forming apparatus through an opening formed in the housing, the waste toner container comprising:

a casing configured to accommodate waste toner therein, the casing having a first end and a second end positioned opposite to the opening with respect to the first end in a state where the waste toner container is attached to the housing, a direction connecting the first end to the second end being a first direction, and a direction crossing the first direction being a second direction;

a guide pipe connected to the casing and configured to guide the waste toner into the casing, the guide pipe having an inlet opening through which the waste toner is introduced into the guide pipe, the guide pipe being pivotally movable relative to the casing between a first position and a second position, the guide pipe at the first position extending in the first direction, the guide pipe at the second position extending in the second direction, the guide pipe at the first position having a length in the second direction smaller than a length in the second direction of the guide pipe at the second position; and a spring configured to urge the guide pipe at the second position toward the first position.

11. The waste toner container according to claim 10, wherein the image-forming apparatus further includes a photosensitive drum and a belt in contact with the photosensitive drum, the waste toner container further comprising a belt cleaning member in contact with the belt for cleaning the belt in the state where the waste toner container is attached to the housing.

12. The waste toner container according to claim 10, wherein the guide pipe is configured to expand and contract in an extending direction of the guide pipe.

13. The waste toner container according to claim 12, wherein the guide pipe comprises:

a first pipe connected to the casing; and a second pipe having the inlet opening and slidable relative to the first pipe in an extending direction of the first pipe, the guide pipe being configured to expand and shrink in accordance with sliding movement of the second pipe relative to the first pipe.

14. The waste toner container according to claim 13, wherein the first pipe is hollow cylindrical in shape;

wherein the second pipe is hollow cylindrical in shape, the second pipe having one end positioned within the first pipe and another end formed with the inlet opening; and wherein the guide pipe further comprises a spring urging the second pipe in the extending direction of the first pipe such that the second pipe protrudes out from the first pipe.

15. The waste toner container according to claim 13, further comprising a screw rotatable about a rotation axis extending in an axial direction, the screw being configured to rotate to convey the waste toner received in the guide pipe into the casing.

16. The waste toner container according to claim 15, further comprising a conveying member located in the casing and extending in the axial direction, the conveying member being configured to convey the waste toner conveyed into the casing by the screw in a direction crossing the axial direction.

17. A waste toner container attachable to and detachable from a housing of an image-forming apparatus through an opening formed in the housing, the waste toner container comprising:

a casing configured to accommodate waste toner therein, the casing having a first end and a second end positioned opposite to the opening with respect to the first end in a state where the waste toner container is attached to the housing, a direction connecting the first end to the second end being a first direction, and a direction crossing the first direction being a second direction; and a guide pipe connected to the casing and configured to guide the waste toner into the casing, the guide pipe having an inlet opening through which the waste toner is introduced into the guide pipe, the guide pipe being pivotally movable relative to the casing between a first position and a second position, the guide pipe at the first position extending in the first direction, the guide pipe at the second position extending in the second direction, the guide pipe at the first position having a length in the second direction smaller than a length in the second direction of the guide pipe at the second position;

wherein the guide pipe is configured to expand and contract in an extending direction of the guide pipe;

wherein the guide pipe comprises:

a first pipe connected to the casing; and a second pipe having the inlet opening and slidable relative to the first pipe in an extending direction of the first pipe, the guide pipe being configured to expand and shrink in accordance with sliding movement of the second pipe relative to the first pipe;

wherein the first pipe is hollow cylindrical in shape;

wherein the second pipe is hollow cylindrical in shape, the second pipe having one end positioned within the first pipe and another end formed with the inlet opening; and wherein the guide pipe further comprises a spring urging the second pipe in the extending direction of the first pipe such that the second pipe protrudes out from the first pipe.

* * * * *